US005383115A

United States Patent [19]

Lecarpentier

[11] Patent Number: 5,383,115

[45] Date of Patent: Jan. 17, 1995

[54] APPARATUS FOR STATISTICALLY MONITORING THE FLOW OF MAIL THROUGH AN ELECTRONIC POSTAGE METER SYSTEM

[75] Inventor: Marc Lecarpentier, Antony, France

[73] Assignee: Neopost Industrie, Bagneux, France

[21] Appl. No.: 994,301

[22] Filed: Dec. 21, 1992

[30] Foreign Application Priority Data

Dec. 20, 1991 [FR] France ..... 91 15906

[51] Int. Cl.[6] ..... G07B 17/00

[52] U.S. Cl. ..... 364/554; 364/406; 364/464.02

[58] Field of Search ..... 364/406, 464.02, 464.03, 364/554, 466

[56] References Cited

U.S. PATENT DOCUMENTS

| | | | |
|---|---|---|---|
| 4,319,328 | 3/1982 | Eggert . | |
| 4,511,793 | 4/1985 | Racanelli | 364/466 |
| 4,541,053 | 9/1985 | Knoth et al. | 364/466 |
| 4,780,601 | 10/1988 | Vermesse | 235/375 |
| 4,941,091 | 7/1990 | Breault et al. . | |
| 4,984,191 | 1/1991 | Vermesse | 364/464.02 |
| 5,111,030 | 5/1992 | Brasington et al. | 364/466 |
| 5,257,197 | 10/1993 | Günther et al. | 364/464.02 |

FOREIGN PATENT DOCUMENTS

| | | |
|---|---|---|
| 0207492 | 1/1987 | European Pat. Off. . |
| 0209392 | 1/1987 | European Pat. Off. . |
| 0285956 | 10/1988 | European Pat. Off. . |
| 0328059 | 8/1989 | European Pat. Off. . |
| 2626995 | 8/1989 | France . |
| 2032224 | 4/1980 | United Kingdom . |

*Primary Examiner*—Emanuel T. Voeltz
*Assistant Examiner*—Craig Steven Miller
*Attorney, Agent, or Firm*—Sughrue, Mion, Zinn, Macpeak & Seas

[57] ABSTRACT

Apparatus for statistically monitoring the flow of mail through an electronic postage meter system, the apparatus including a memory used for recording statistical readings, said apparatus being characterized in that a saved region of the read/write portion of the memory contains at least one statistics counter and, in association with said statistics counter, at least one sorting criterion related to postage value, the counter corresponding to a specific category of mail or mode of posting.

8 Claims, No Drawings

APPARATUS FOR STATISTICALLY MONITORING THE FLOW OF MAIL THROUGH AN ELECTRONIC POSTAGE METER SYSTEM

The invention relates to electronic postage meter systems, and in particular to statistically monitoring the flow of mail therethrough.

The invention applies particularly to electronic postage meter systems that are associated with a clearing center which oversees them, and which, in certain cases, re-loads funds into the electronic postage meter systems that are associated therewith.

Various apparatuses have been made for re-loading electronic postage meter systems with funds from a clearing center, the apparatuses being designed to ensure that systems cannot be re-loaded with funds either fraudulently or accidentally. Such an apparatus is disclosed, for example, in French Patent No. 86 05588 and in European Patent Application No. 0207492 which respectively describe an electronic security module and a chip card enabling data interchange between an electronic postage meter system and a clearing center, mainly for the purposes of re-loading the electronic system with funds.

In a variant described in French Patent No. 85 10081, the above-mentioned module is replaced by a telephone line which transmits data in both directions, the data being suitably encrypted so as to avoid any error or fraud.

Advantageously, the module or the telephone line also enables commands to be sent from the clearing center to the electronic postage meter systems, and statistical readings to be transferred from a postage meter system memory to the clearing center. The commands include, in particular, instructions defining conditions for taking statistical readings so that the postal authorities can obtain better understanding of the use of electronic postage meter systems. The second above-mentioned document discloses that such instructions relate to the number, the capacity, and the frequency of the readings taken from statistics counters situated in said memory of an electronic postage meter system. The number of statistics counters is a function, in particular, of postage rates, each counter being associated with a range of postage values.

The data obtained from such statistics counters does not enable the postal authorities to reconstruct the flow of mail corresponding to the various electronic postage meter systems for a specific category of mail or mode of posting.

An object of the present invention is to provide apparatus enabling the flow of mail through an electronic postage meter to be statistically monitored, and supplying an itemized breakdown as a function of a specific category of mail or mode of posting.

To this end, the invention provides apparatus for statistically monitoring the flow of mail through an electronic postage meter system, the apparatus including a memory used for recording statistical readings, said apparatus being characterized in that a saved region of the read/write portion of the memory contains at least one statistics counter and, in association with said statistics counter, at least one sorting criterion related to postage value, the counter corresponding to a specific category of mail or mode of posting.

By choosing postage values as the only sorting criteria, the apparatus makes it possible to have a particularly simple and flexible system both for identifying a category of mail or mode of posting, and for providing itemized billing of postal consumption.

In practice, about eight statistics counters are sufficient for identifying the most commonly used categories of mail or modes of posting.

Advantageously, each statistics counter operates by incrementation to count the number of postal items franked, and the postage values corresponding thereto.

Preferably, each statistics counter occupies seven eight-bit bytes in the region of read/write memory that is saved, three bytes being assigned to counting the number of items franked, and four bytes being assigned to counting the corresponding postage values for the category of mail or mode of posting that is specific to the statistics counter in question. This enables up to a million franking cycles to be counted for a total postage value of one million francs. Each statistics counter may be associated with eight different sorting criteria, e.g. corresponding to postage values, it being understood that the same sorting criterion cannot be used by two different statistics counters.

The values of the sorting criteria are characteristic of the categories of mail or modes of posting, and are transmitted by the postage meter center to the electronic postage meter systems either via an electronic module which is transported from the postage meter center to the location of each electronic postage meter system, or else via a telephone line which connects the clearing center to the electronic postage meter systems.

The values of the statistics counters are transmitted by each electronic postage meter system to the clearing center via the electronic module or via the telephone line.

Preferably, the statistics counters and the sorting criteria related to postage values are part of the contents of the electronic messages interchanged between the clearing center and the electronic postage meter systems at the time when the postage meter systems are being re-loaded with funds. It is understood that the sorting criteria for an electronic postage meter system may be modified each time data is interchanged between the clearing center and the electronic postage meter system.

The solution described above offers the advantage of being simple and flexible, and of monitoring many postage values, thereby improving the statistics. Since certain categories of mail or modes of posting do not use equal numbers of postage values, the saved region of the read/write portion of the memory is subdivided into registers accessible via an index so as to optimize occupation of the memory. Each register references a specific statistics counter and may be associated with a minimum number of sorting criteria actually used by the statistics counter. To this end, an electronic message conveyed between the clearing center and an electronic postage meter system has a format which, in addition to the conventional bytes dedicated to identification data, and to the conventional bytes concerning the state of credit, includes a plurality of extra bytes dedicated to data related to the sorting criteria and in the following form:

- an identification byte for identifying the register associated with the first statistics counter;
- bytes relating to one or more sorting criteria associated with the first statistics counter;
- an identification byte for identifying the register associated with the second statistics counter; and bytes relating to one or more sorting criteria associated with the second statistics counter, etc.

In practice, electronic postage meter systems in service are provided with two backed-up read/write memories, each memory having a capacity of 128 bytes. The two read/write memories are doubled to take into account the statistics counters and the sorting criteria.

By taking a block of M bytes for installing the statistics counters, it is possible to define the maximum number of available statistics counters by means of the following relationship:

maximum number of counters=M/7;

i.e. for a block of 128 bytes, there are 18 statistical criteria available.

In the same way, by taking a block of M bytes for installing the sorting criteria, it is possible to define the maximum number of available sorting criteria by means of the following relationship:

number of sorting criteria=½ (M—number of statistics counters);

i.e. for a block of 128 bytes, and for:

18 statistics counters→55 sorting criteria;

15 statistics counters→56 sorting criteria;

10 statistics counters→59 sorting criteria;

etc . . .

The invention is very simple and cheap to implement, and may be applied to electronic postage meter systems already in service, providing that they are modified, with such modification being cheap to perform.

I claim:

1. An apparatus for statistically monitoring the flow of mail through an electronic postage meter for a specific mail category or mode of posting, said postage meter comprising a memory used for recording statistical readings, said apparatus comprising:

a) means for allocating a first area of said memory for storing NSC statistics counters, each statistics counter relating to a specific category of mail or mode of posting;

b) means for allocating a second area of said memory for storing nsc ranges of postage values with nsc greater than NSC;

c) means for allocating a third area of said memory for storing extra data partitioning said nsc ranges of postage values, each partition comprising one or more of said nsc ranges of postage values characterizing a specific mail category or mode of posting and relating to one of said NSC statistics counters; and d) means for responding to franking of an item of mail by the postage meter with a particular postage falling into one of said nsc ranges of postage values, incrementing a statistics counter among said NSC statistics counters which relates to said one of said nsc ranges of postage values.

2. Apparatus according to claim 1, in which the occupation of said first area and said second area of a read/write portion of the memory is optimized as a function of the number NSC of statistics counters and of the number nsc of ranges of postage values associated to each statistics counter, by retaining only a variable minimum number of the ranges of postage values for a given statistics counter.

3. Apparatus according to claim 1, in which a statistics counter occupies seven bytes in the first area of a read/write portion of the memory, three bytes being assigned to incrementing the number of franking operations, and four bytes being assigned to incrementing the postage value for the category of mail or mode of posting that is specific to said statistics counter.

4. Apparatus according to claim 1, in which each range of postage values occupies two bytes in the second area of a read/write portion of the memory.

5. Apparatus according to claim 1, in which the postage meter system is associated with a clearing center for the purposes of interchanging data in the form of electronic messages, and the statistics counter and the ranges of postal values are part of the contents of the electronic messages.

6. Apparatus according to claim 5, in which the electronic messages are conveyed by means of an electronic module transported from the location of the postage meter system to the clearing center and vice versa.

7. Apparatus according to claim 5, in which the electronic messages are conveyed by means of a telephone line connecting the postage meter system to the clearing center.

8. A method for statistically monitoring the flow of mail through an electronic postage meter for a specific mail category or mode of posting, said postage meter comprising a memory used for recording statistical readings, said method comprising the steps of:

a) allocating a first area of said memory for storing NSC statistics counters, each statistics counter relating to a specific category of mail or mode of posting;

b) allocating a second area of said memory for storing nsc ranges of postage values with nsc greater than NSC;

c) allocating a third area of said memory for storing extra data partitioning said nsc ranges of postage values, each partition comprising one or more of said nsc ranges of postage values characterizing a specific mail category or mode of posting and relating to one of said NSC statistics counters; and d) response to franking of an item of mail by the postage meter with a particular postage falling into one of said nsc ranges of postage values, incrementing a statistics counter among said NSC statistics counters which relates to said one of said nsc ranges of postage values.

* * * * *